US005178819A

United States Patent [19]

Schoennahl

[11] Patent Number: 5,178,819

[45] Date of Patent: Jan. 12, 1993

[54] TUYERE BLOCKS OF VERTICAL REACTOR FURNACES

[75] Inventor: Jacques Schoennahl, Villeurbanne, France

[73] Assignee: Savoie Refractaires, Venissieux, France

[21] Appl. No.: 677,417

[22] Filed: Mar. 29, 1991

[30] Foreign Application Priority Data

Apr. 6, 1990 [FR] France ..... 90 04452

[51] Int. Cl.[5] ..... C21B 7/16

[52] U.S. Cl. ..... 266/265; 110/182.5; 122/6.6

[58] Field of Search ..... 122/6.6; 110/182.5; 266/265

[56] References Cited

U.S. PATENT DOCUMENTS

| | | | |
|---|---|---|---|
| 3,589,318 | 6/1971 | Szatkowski | 110/182.5 |
| 4,172,107 | 10/1979 | Nakamura et al. . | |
| 4,366,258 | 12/1982 | Eschenberg | 266/280 |

FOREIGN PATENT DOCUMENTS

| | | | |
|---|---|---|---|
| 2854998 | 4/1980 | Fed. Rep. of Germany . | |
| 3736914 | 5/1988 | Fed. Rep. of Germany . | |
| 8910674 | 11/1989 | Fed. Rep. of Germany . | |
| 1401132 | 4/1965 | France . | |
| 89709 | 5/1984 | Japan | 266/265 |
| 1044760 | 10/1966 | United Kingdom . | |

OTHER PUBLICATIONS

Patent Abstracts of Japan, vol. 7, No. 53 (C-154) [1198], Mar. 3, 1983.

*Primary Examiner*—Melvyn J. Andrews

*Attorney, Agent, or Firm*—Watson, Cole, Grindle, & Watson

[57] ABSTRACT

A tuyere opening assembly of a vertical furnace or reactor includes at most four prefabricated elements made of moulded refractory concrete, and a lining therein of ceramized refractory keys of identical shape and size arranged therein for receiving a burner or a tuyere.

4 Claims, 2 Drawing Sheets

TUYERE BLOCKS OF VERTICAL REACTOR FURNACES

BACKGROUND OF THE INVENTION

The present invention relates to improvements to tuyere opening assemblies of vertical furnaces and reactors.

Vertical furnaces and reactors operating at high temperatures, such as, for example, blast furnaces and cupola furnaces, are conventionally heated by an assembly of burners or of hot-gas injection tuyeres arranged in a ring in relation to the interior of the furnace or reactor. The usually removable metal burners or tuyeres are seated in tuyere opening assemblies consisting of pieces of refractory material. These refractory pieces are subjected to high mechanical and thermal stresses and to considerable corrosion. A distinction can be made particularly between:

static mechanical stresses occurring as a result of the weight of the masonry and of the containment forces exerted by the outer metal casing of the furnace or reactor;

dynamic mechanical stresses occurring as a result of the abrasion brought about by the solid charge descending in the furnace or reactor and of the erosion caused by the streaming of molten glass, slag and/or metal along the pieces or by the hot gases rising in the furnace or reactor;

thermomechanical stresses attributable to the high temperatures prevailing in the furnace or reactor to the thermal gradients present in the stabilized operating mode or to the thermal shock occurring during the shutdown and restarting of the burners or the injection of hot gases through the tuyeres;

the corrosion which can take place either on the surface of the pieces in contact with the charge of the furnace or reactor or in the thickness of the pieces as a result of the infiltration or diffusion of aggressive elements emitted by the furnace or reactor charge.

These stresses and the corrosion experienced generate a process in which the pieces are destroyed.

Thus, for example, as regards tuyere opening assemblies blast furnaces, the component pieces of the assemblies are subject to cracking by thermal shock, to impregnation by potassium vapours condensing in the form of $K_2O$ or $K_2CO_3$ and attacking the refractory material in depth so as to make it brittle, and to wear by abrasion and erosion caused by the descending charge on the material embrittled by the previous attacks.

It is therefore essential that tuyere opening assemblies of vertical furnaces or reactors should have high resistance to thermal shock and high mechanical strength, which is maintained even in the event of a chemical attack in depth.

Tuyere opening assemblies are traditionally formed by assembling a large number of ceramised refractory keys, for example made of silicon carbide with a silicon nitride binder or based on corundum grains with a mullite or sialon binder, of different and relatively complex shapes.

This technology, although satisfactory, nevertheless involves a very high outlay because for the manufacturer it implies the production of a large number of moulds and the use of non-automated shaping techniques, such as manual ramming, and for the user it implies the need to provide qualified labour. Moreover, the assembly time on site is very long, typically approximately seven days for a ring of tuyeres of a blast furnace.

To save time during assembly on site, it has been proposed to supply sets of keys in preassembled form, that is to say, fixed together at the factory by known means, for example by the use of a cement. However, this technique does not afford any other advantage in comparison with traditional practice.

It has also been proposed to produce each tuyere belt or block no longer by assembling a large number of elementary keys, but by assembling a small number (for example, four) of suitably shaped elements obtained by moulding a refractory concrete. This procedure makes it possible to minimize the mould and labour costs and to save time during assembly on site: the assembly time can thus be reduced, for example, to 4–5 days instead of 7 days involved in the assembly of keys.

But experience has shown that, even with the use of the best available refractory concretes of high compactness, such as those described in French Patent 2,390,400 or the corresponding German Patent 2,759,809, the resulting tuyere opening assemblies exhibited, in use, a resistance to abrasion and to erosion under hot conditions far lower than that of high-temperature ceramised keys, particularly those of keys based on corundum grains and/or silicon carbide with a nitride or sialon binder, especially when there is simultaneously corrosion in the mass as a result of the infiltration or diffusion of aggressive elements, such as $K_2O$ or $K_2CO_3$.

Another version which has been tested involves producing the tuyere opening assemblies by assembling 4 carbon blocks machined to shape. This solution is unsatisfactory, however, because it leads to high thermal losses and the carbon blocks experience rapid wear by oxidation.

The object of the present invention is to provide improved tuyere opening assemblies for vertical furnaces or reactors which avoid the above-mentioned problems.

SUMMARY OF THE INVENTION

More specifically, the invention relates to a tuyere opening assembly of a vertical furnace or reactor, formed by assembling at most four prefabricated elements made of moulded refractory concrete, wherein each element possesses, furthermore, a lining bound to the concrete and consisting of ceramised refractory keys of identical shape and size forming a unitary composite assembly with the element and arranged between the part of the element made of moulded refractory concrete and the orifice intended for receiving a burner or a tuyere.

The ceramised keys forming the lining, because they are all of the same shape and size, can be produced easily by an automatic shaping process, for example by uniaxial pressing. There will preferably be used as component materials of these ceramised keys a material based on grains of corundum and/or silicon carbide bound by a nitride or sialon binder, such as the product CORANIT®, comprising approximately 75% of alumina and 25% of a nitrided binder of the sialon and silicon oxynitride type, the product SICANIT® 20 comprising approximately 76% of silicon carbide and 25% of a nitrided binder, or the product SICANIT® AL comprising approximately 9.5% of alumina, 67% of silicon carbide and 23.5% of a nitrided binder of the sialon type, all of which are sold by the applicant.

The key lining can be installed either at the time of the moulding of the concrete part of the elements, by placing the keys in the mould serving for the moulding of the concrete during the casting of the latter, or after the removal of the concrete part of the elements from the mould, by jointing with a refractory cement, so that the concrete/key combination forms a unitary composite assembly.

The refractory concretes which may be used are those described in French Patent 2,390,400 or the corresponding German Patent 759,809, the teachings of which are incorporated herein by reference, with the exception of the concretes containing carbon, the presence of which is to be avoided. In brief, these concretes are formed, in terms of weight, by (A) 70–90% of a refractory granulate and by (B) 10–30% of a cement consisting of (i) 10–30% of an alkaline-earth mineral substance, (ii) 14–54% of ultrafine particles of a particle size of 100 nm to 0.1 microns, and (iii) 14–54% of fine particles of a particle size of 1 to 10 microns. Of this group of concretes, it is preferable to use in particular vibrated concretes comprising a granulate formed from alumina with a hydraulic binder, such as the concrete CRISTARAM® with 93% of alumina, the granulate of which is white corundum requiring only 3% of water and having a density of 3250 kg/m$^3$ and a resistance to crushing under cold conditions higher than 140 MPa, or the concrete CORAL® with 89% of alumina, the granulate of which is brown corundum requiring only approximately 2.5% of water and having a density of 3350 kg/m$^3$ and a resistance to crushing under cold conditions higher than 50 MPa, both of which are sold by the applicant. Moreover, such concretes afford the advantage of being thermally insulating, possessing a thermal conductivity at 800° C. of approximately 4 W/m K. As a comparison, materials based on carbon or on silicon carbide have a thermal conductivity of more than 15 W/m K.

Advantageously, elements made of moulded refractory concrete are reinforced by incorporating reinforcing elements, such as stainless steel fibres, in the concrete used. As an example, approximately 1 to 3% of reinforcing elements can be incorporated. One example of stainless steel reinforcing fibres available in the trade are the fibres ZP 30/40 SS 304 sold by DRAMIX company. The addition of steel reinforcing fibres improves the resistance to fragmentation by thermal shock, thus preventing the breaking up of the pieces. Surprisingly, tests showed that the resistance to corrosion by carbon monoxide is not adversely affected by the incorporation of steel fibres, as might have been feared.

The following description made with reference to the drawing will make it easy to understand the invention.

DETAILED DESCRIPTION OF THE PREFERRED EMBODIMENT

Figure 2:
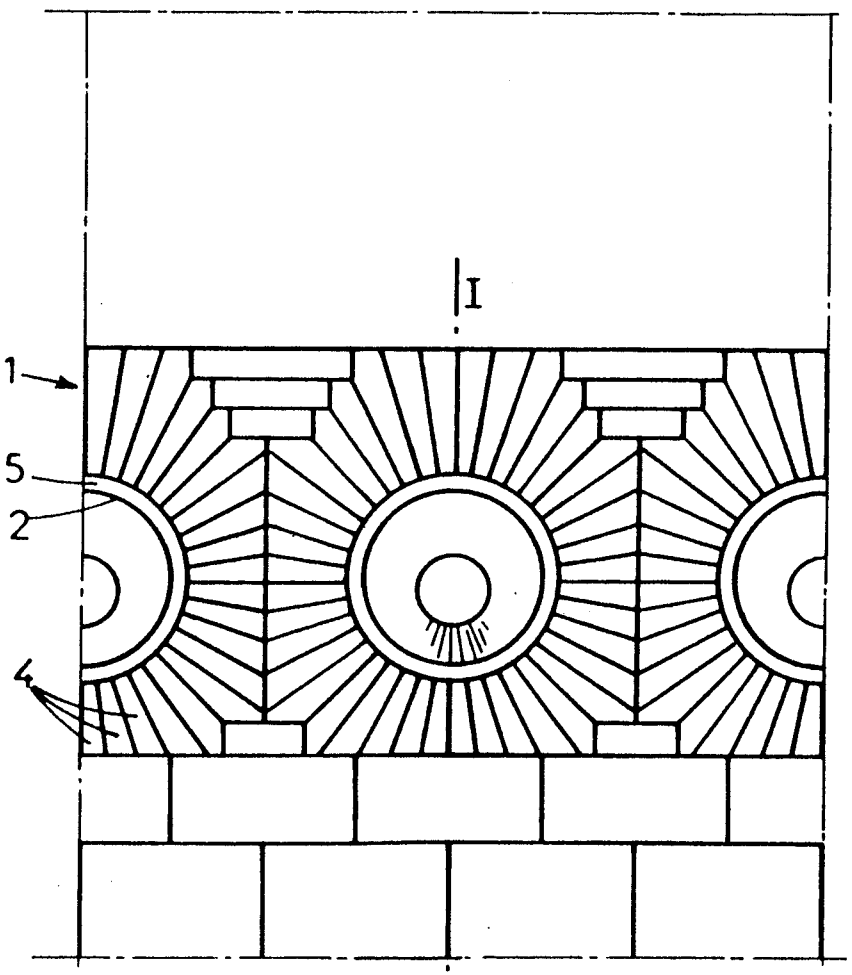
FIG. 2 PRIOR ART
FIGS. 1 and 2 are respectively diagrammatic sectional and front views of a traditional blast-furnace tuyere opening assembly.
Figure 1:
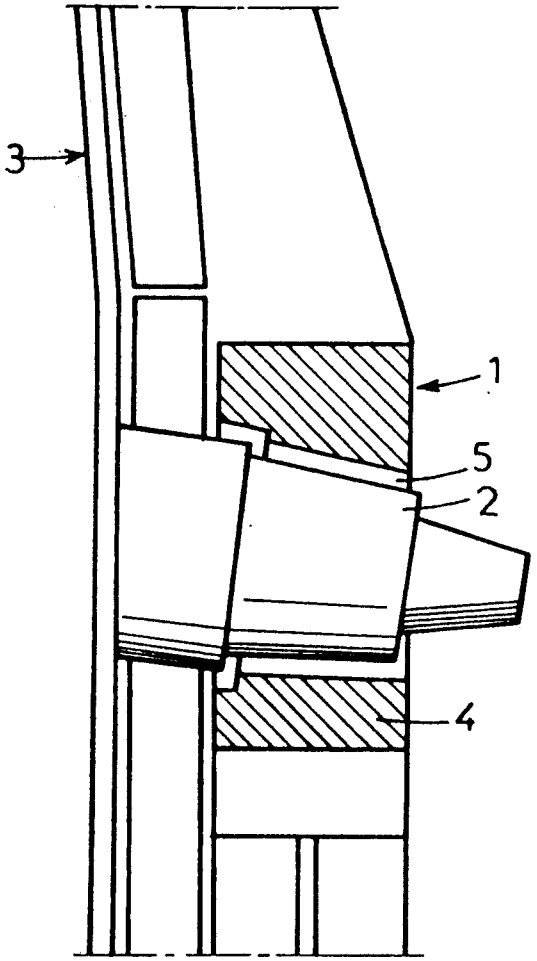
FIG. 1 PRIOR ART

FIGS. 1 and 2 illustrate a conventional block 1 of a tuyere 2 of a blast furnace 3 (shown partially). This opening assembly represented by hatching in FIG. 1, is formed by assembling a large number of ceramised refractory keys 4 of different shapes, the resulting assembly delimiting an orifice or passage 5 designed for receiving the frustoconical tuyere 2 the axis of which is inclined slightly downwardly.

Figure 4:
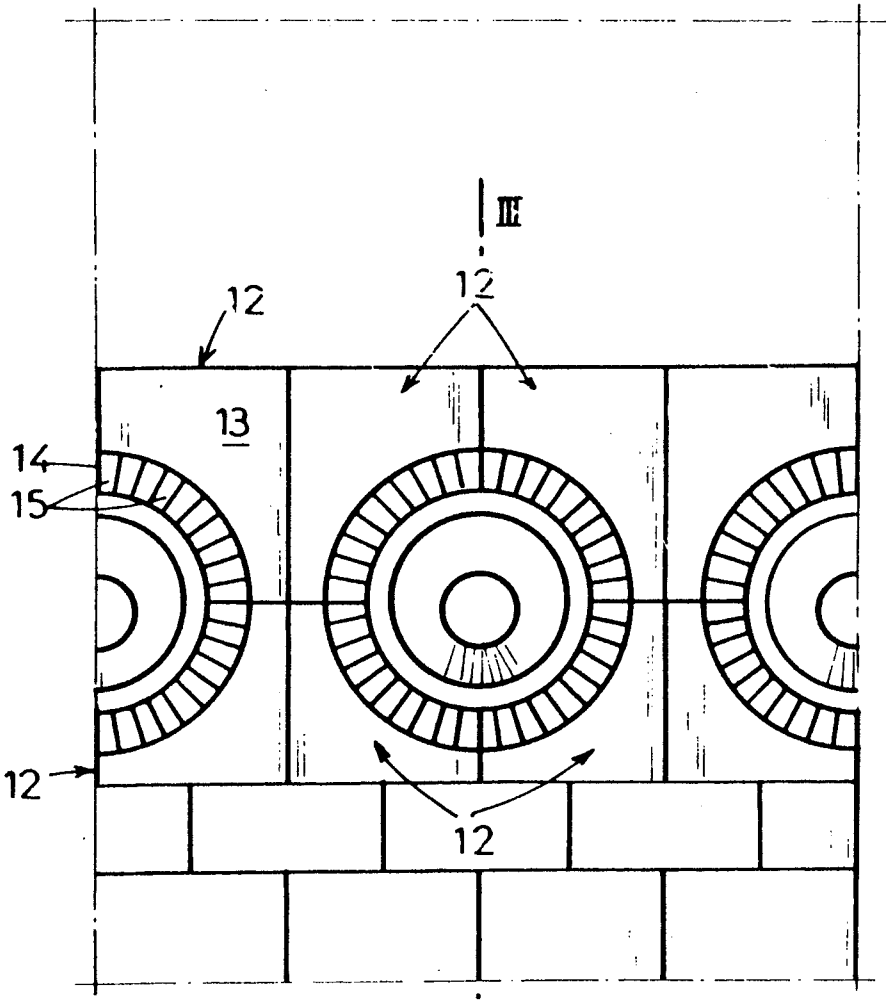
FIGS. 3 and 4 are respectively diagrammatic sectional and front views of a blast-furnace tuyere opening assembly according to the invention.
Figure 3:
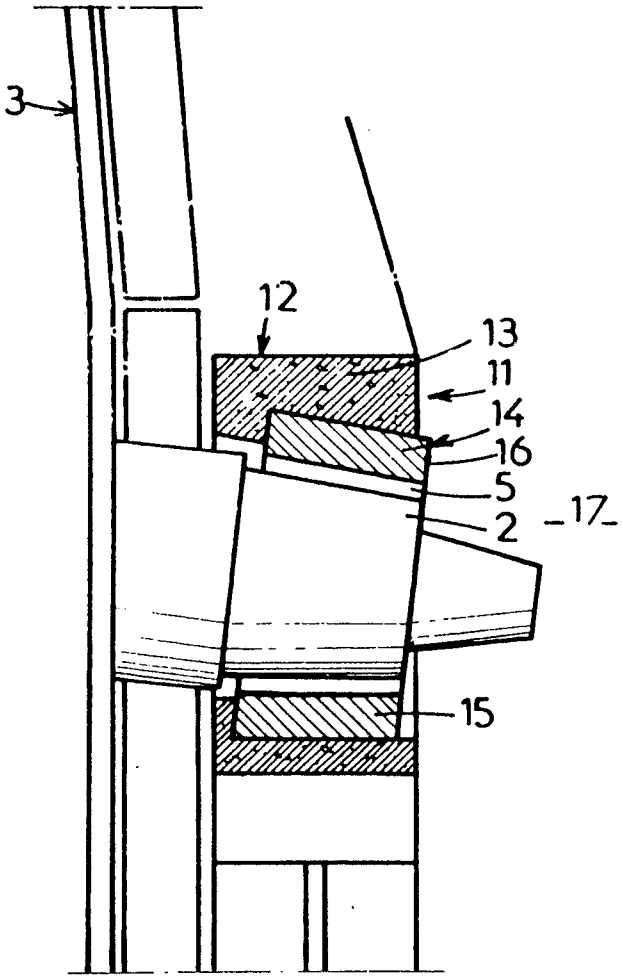

FIGS. 3 and 4 illustrate a tuyere opening assembly according to the invention. This opening assembly 11 is formed by assembling four prefabricated elements 12. Each element 12 is formed from an outer part 13 made of moulded refractory concrete (represented by fine hatching in FIG. 3), fixed to an inner lining 14 delimiting the orifice or passage 5 intended for receiving the tuyere 2 of the blast furnace 3 and formed by assembling ceramised refractory keys 15 of identical shape and size which have the form of a wedge in both their vertical and longitudinal directions. Advantageously, these keys extend only over part of the total thickness of the elements 12, this part including the face of the elements turned towards the interior of the furnace or reactor. This is expedient from an economic point of view because it makes it possible to reduce the amount of material forming these keys, which is an expensive material. Once the four elements 12 are assembled, the linings 14 together form an inner ring of frustoconical shape, the axis of which is inclined slightly downwardly and which is embedded in the parts 13 made of refractory concrete of the elements, the front face 16 of this ring being located towards the interior 17 of the blast furnace.

The elements 13 are composite ceramised concrete/-key elements which show excellent behaviour in operation. The inner ring of ceramised refractory keys (for example, made of corundum and/or silicon carbide with a nitride or sialon binder) possesses at the same time excellent resistance to thermal shock, low thermal conductivity, a very high mechanical strength (making it possible to withstand the static mechanical stresses exerted on the surround as a whole) and excellent abrasion and erosion resistance (making it possible to retard the wear of the refractory concrete parts surrounding it).

The parts made of moulded concrete can themselves be considered as performing the function of a cradle holding the keys or of a filling material.

It should be noted that the elements 12 can be assembled simply by juxtaposing the elements, with or without jointing by means of a refractory cement or mortar.

It goes without saying that the embodiment described is only an example and that it could be modified, particularly by the substitution of technical equivalents, without thereby departing from the scope of the invention.

I claim:

1. A tuyere block to be positioned in a vertical wall defining a furnace or reactor interior, for defining a passage in which a tuyer or burner can be mounted, said tuyere block consisting of a plurality of prefabricated elements which each has a first surface to be positioned in said vertical wall of said furnace or reactor interior, each of said elements being made of molded refractory concrete and being provided with a protective lining, said protective lining being composed of a plurality of identical ceramic refractory keys united to said concrete and consisting essentially of grains of at least one of corundum and silicon carbide bonded by a nitride or sialon binder, said elements being positioned together such that said ceramic refractory keys form a passage in which a tuyere or burner can be mounted.

2. A tuyere block according to claim 1, wherein the refractory concrete from which said prefabricated elements are made comprises a granulate of alumina and a hydraulic binder.

3. A tuyere block according to claim 1, wherein said prefabricated elements provide a second end surface opposite said first end surface and define a thickness therebetween, wherein said keys extend from said first end surfaces of said elements towards said second end surfaces thereof, but have a length which is less than said thickness.

4. A tuyere block according to claim 1, including four prefabricated elements.

* * * * *